United States Patent [19]

Bergman

[11] 4,250,864

[45] Feb. 17, 1981

[54] STOVE HEAT EXCHANGER

[76] Inventor: Ernest R. Bergman, 551 E. Maple, Troy, Mich. 48084

[21] Appl. No.: 44,795

[22] Filed: May 31, 1979

[51] Int. Cl.[3] ..... F24C 13/00

[52] U.S. Cl. ..... 126/34; 126/5; 126/53

[58] Field of Search ..... 126/34, 35, 5, 53, 65, 126/54, 121, 120, 132, 344, 365, 364

[56] References Cited

U.S. PATENT DOCUMENTS

| | | | |
|---|---|---|---|
| 528,388 | 10/1894 | Phillips | 126/34 |
| 4,154,210 | 5/1979 | Jaymes | 126/34 |
| 4,159,802 | 7/1979 | Ficker et al. | 126/121 |
| 4,180,053 | 12/1979 | Patel | 126/121 |

FOREIGN PATENT DOCUMENTS

| | | | |
|---|---|---|---|
| 615254 | 10/1926 | France | 126/34 |

*Primary Examiner*—Samuel Scott
*Assistant Examiner*—Wesley S. Ratliff, Jr.
*Attorney, Agent, or Firm*—Reising, Ethington, Barnard, Perry & Brooks

[57] ABSTRACT

A heat exchanger (10) disclosed functions as a grate for an enclosed stove and includes a front hearth section (14) of an upwardly opening U-shape including tubing for carrying a fluid to be heated. An open end of the front hearth section allows an associated stove to be stroked through a front door opening thereof as well as through a top opening of the stove. A rear flue section (20) of the heat exchanger includes tubing for carrying fluid to provide preheating thereof by flue gases prior to passage to the hearth section. Inlet and outlet tubes (24, 26) of the heat exchanger respectively supply the fluid to be heated to the flue section and receive the heated fluid from the hearth section. A central connector tube (28) preferably extends between the flue and hearth sections with grate tubes (30) of the hearth section extending from the connector tube to define the U-shape thereof and with a pair of the outlet tubes communicated with upper ends of the grate tubes. U-shaped tubes (32) of the flue section open sideways in opposite directions and have upper ends communicated with the inlet tube and lower ends communicated with the connector tube that feeds the hearth section.

3 Claims, 5 Drawing Figures

STOVE HEAT EXCHANGER

TECHNICAL FIELD

This invention relates generally to heat exchangers and more particularly to a heat exchanger for an enclosed stove.

BACKGROUND ART

Prior art references have taught the provision of a heat exchanger usable as a grate for a fireplace and including tubing for carrying a fluid to be heated by the heat exchanger. Air can be utilized as the fluid to be heated so that the heated air is distributed through a register to the room in which the fireplace is located or to an adjacent room through suitable ducts. Likewise, water or any other liquid can be utilized with such a heat exchanger to function in a radiator heating system, a convective heating system, or a radiant heating system of either the floor, ceiling, or baseboard type. Fireplace heat exchangers of this type are disclosed by U.S. Pat. Nos. 495,418; 547,802; 670,066; 1,252,176; 1,426,976; 1,549,071; 2,172,711; 4,025,043; 4,046,320; and 4,074,676. Other fireplace heat exchangers are disclosed by U.S. Pat. Nos. 712,672 and 3,394,697.

Enclosed stoves which are normally designed to burn wood or coal function much more efficiently than fireplaces since the supply of oxygen to the burning fire can be limited and the distribution of the heat to the room radiates in all directions from the stove body. However, as with fireplaces, some heat is lost through the flue to the environment.

DISCLOSURE OF INVENTION

An object of the present invention is to provide an improved heat exchanger that is used as a grate for an enclosed stove in order to provide highly efficient heating.

In carrying out the above object as well as other objects of the invention, the heat exchanger includes a front hearth section of an upwardly opening U-shape including tubing for carrying a fluid such as air or water, etc. that is to be heated. An open front end of the hearth section allows a stove associated with the heat exchanger to be stoked through a front door opening thereof as well as through a top opening. A rear flue section of the heat exchanger includes tubing for carrying the fluid in order to provide preheating thereof by flue gases prior to passage of the fluid to the hearth section. Inlet and outlet tubes of the heat exchanger respectively supply the fluid to be heated to the flue section and receive the heated fluid from the hearth section.

In its preferred construction, the heat exchanger includes a central connector tube extending between the flue section and the hearth section. Grate tubes of the hearth section extend from the connector tube to define the U-shape thereof and have lower ends communicated with the connector tube as well as upper ends spaced from each other. A pair of the outlet tubes are communicated with the upper ends of the grate tubes and extend in a parallel relationship with each other as well as with the central connector tube. U-shaped tubes of the flue section open sideways in opposite directions and have upper ends communicated with the inlet tube and lower ends communicated with the connector tube that feeds the hearth section. The inlet tube also extends parallel to the connector and outlet tubes and is located above the connector tube at the same elevation as the outlet tubes. The grate tubes of the hearth section and the U-shaped tubes of the flue section have smaller sizes than the inlet tube, the connector tube, and the outlet tubes in order to provide the proper rate of flow through the tubes of each section and thereby achieve efficient capturing of the heat generated by a fire burning in the hearth section.

Other objects, features, and advantages of the present invention will become apparent from the following detailed description of the best mode for carrying out the invention when taken in connection with the accompanying drawings.

BEST MODE FOR CARRYING OUT THE INVENTION

Figure 1:
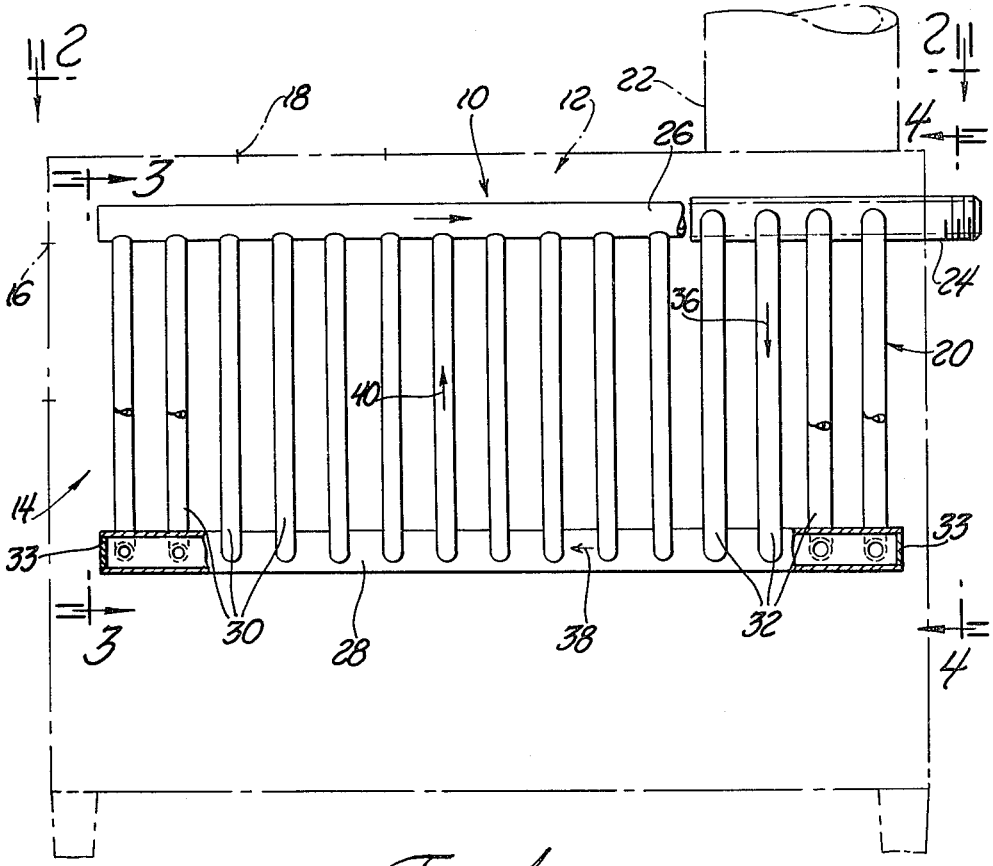
FIG. 1 is a partially broken away side elevation view of a stove heat exchanger constructed in accordance with the present invention.
Figure 2:
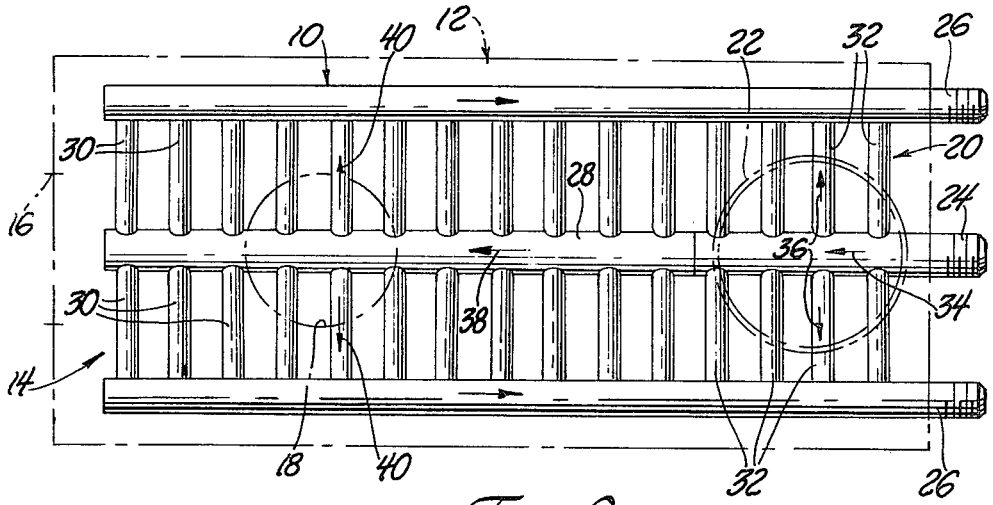
FIG. 2 is a top plan view of the heat exchanger taken along line 2—2 of FIG. 1.

Referring to FIGS. 1 and 2 of the drawings, a heat exchanger constructed according to the present invention is generally indicated by reference numeral 10 and is utilized with an enclosed stove that is shown by phantom line representation and indicated by reference numeral 12. Heat exchanger 10 is supported in any suitable manner within the stove 12 in the position shown and includes a front hearth section 14 of an upwardly opening U-shape (FIG. 5) defined by tubing that carries a fluid to be heated by a fire burning in the hearth section. The front end of the hearth section 14 is open so that the stove 12 can be stoked through a front door opening 16 (FIGS. 1 and 2) as well as through a top opening 18 of the stove. A rear flue section 20 of the heat exchanger includes tubing for carrying the fluid in order to provide preheating thereof by the flue gases that pass upwardly through the flue 22 so that the fluid is heated somewhat prior to passage to the hearth section 14. An inlet tube 24 supplies the fluid to be heated to the flue section 20 while a pair of outlet tubes 26 receive the heated fluid from the hearth section 14.

Forced air, water, or another liquid can be utilized as the fluid that is supplied to the heat exchanger 10 in order to capture heat from a fire built in the hearth section 14. For example, a positive pressure air blower may supply pressurized air to the inlet tube 24 so that the air is initially preheated in the flue section 20 prior to passage to the hearth section 14 and subsequent flow through the outlet tubes 26 for distribution through one or more registers to the room in which the stove is heated. Similarly, a vacuum blower may be connected to the outlet tubes 26 to pull air into the inlet tube 24 and through the flue section 20 and the hearth section 14 in order to provide the heating. Likewise, water or another liquid may be utilized with a radiator heating system, a convective heating system, or a radiant heat system of the ceiling, floor, or baseboard type.

Figure 5:
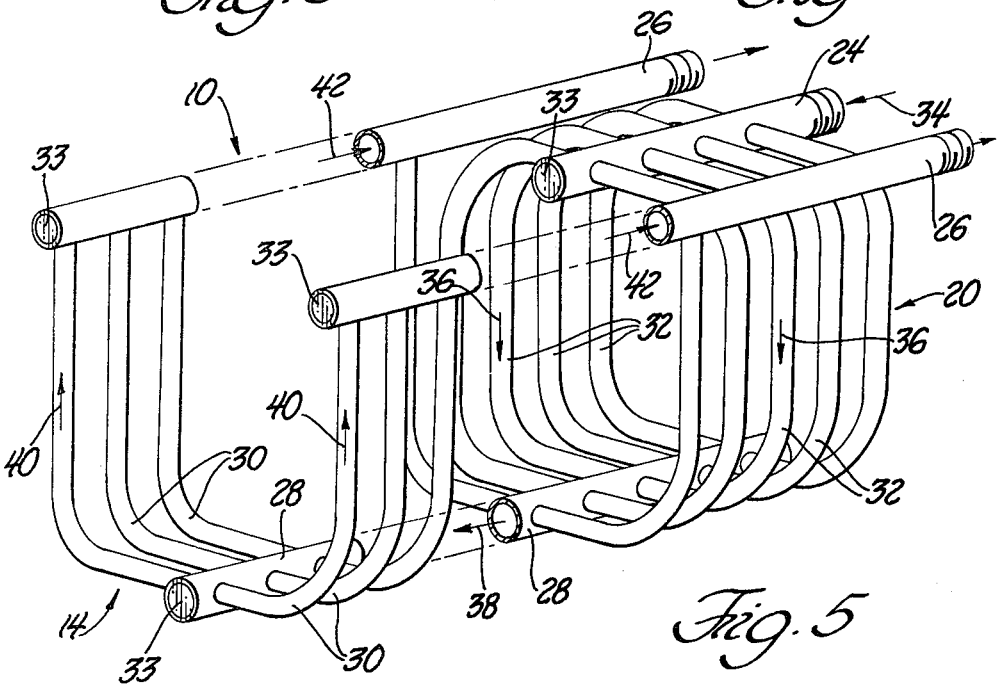
FIG. 5 is a partially broken away perspective view of the heat exchanger.

With particular reference to FIG. 5, heat exchanger 10 includes a central connector tube 28 that extends forwardly and rearwardly between the front hearth section 14 and the rear flue section 20. Grate tubes 30 of the hearth section 14 extend from the connector tube 28 to define the upwardly opening U-shape that allows the hearth section to be stoked from both the front and the top. Lower ends of the grate tubes 30 are communicated with the connector tube 28 so as to receive the preheated fluid from the flue section 20 prior to heating thereof by the fire built in the hearth section. Upper ends of the grate tubes 30 are spaced from each other and communicated with the two outlet tubes 26 which extend parallel with the connector tube 28 and with each other at the same upper elevation as the inlet tube 24 which is located above the connector tube.

Flue section 20 of the heat exchanger is seen in FIG. 5 as including U-shaped tubes 32 that open sideways in opposite directions. Upper ends of the tubes 32 are communicated with the inlet tube 24 through which fluid to be heated is fed into the heat exchanger 10. Lower ends of the U-shaped tubes 32 are communicated with the connector tube 28 that feeds the preheated fluid from the flue section 20 to the hearth section 14.

Figure 3:
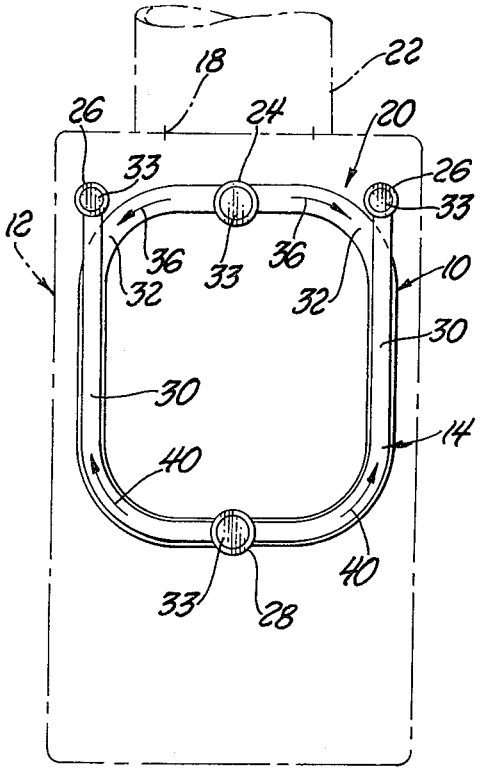
FIG. 3 is a front elevation view of the heat exchanger taken along line 3—3 of FIG. 1.
Figure 4:
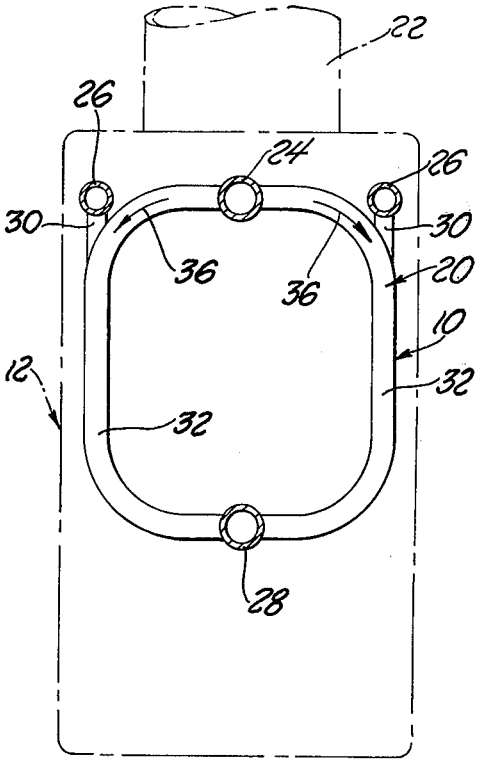
FIG. 4 is a rear elevation view of the heat exchanger taken along line 4—4 of FIG. 1.

Suitable plugs 33 close the front ends of the inlet tube 24, the outlet tubes 26, and the connector tube 28 as well as the rear end of the connector tube as shown in FIGS. 1, 3, and 5.

A detailed description of the passage of the fluid to be heated through the heat exchanger 10 will now be given with reference to the flow arrows that indicate the direction of fluid flow through the tubes of the heat exchanger. Fluid is fed into the inlet tube 24 as shown by arrow 34 (FIGS. 2 and 5) and then flows through the tubes 32 of the flue section 20 as shown by arrows 36 for passage to the connector tube 28. Fluid flow then proceeds from the flue section 20 through the connector tube 28 as shown by arrow 38 (FIGS. 1, 2, and 5) to the hearth section 14 at which the fluid flows upwardly around a burning fire in the hearth section through the grate tubes 30 as indicated by the arrows 40 in FIGS. 1, 2, 3, and 5. From the tubes 30, the heated fluid then flows rearwardly as shown by arrows 42 (FIGS. 1, 2, and 5) through the outlet tubes 26 for appropriate delivery.

It will be noted that the grate tubes 30 of the hearth section 14 and the U-shaped tubes 32 of the flue section 20 are of a smaller size than the inlet tube 24, the outlet tubes 26, and the connector tube 28 so that the fluid flows at a proper rate through the tubes in order to provide efficient heating. Any suitable material with good heat conductivity such as copper, or aluminum, etc. may be used to make the tubing of the heat exchanger.

While a preferred construction of the stove heat exchanger has herein been described in detail, those familiar with the art to which this invention relates will recognize various alternative designs and embodiments for practicing the invention as defined by the following claims.

What is claimed is:

1. A heat exchanger that functions as a grate for an enclosed stove, the heat exchanger comprising: a front hearth section, a rear flue section, a central connector tube extending between the flue and hearth sections so as to carry a fluid to be heated, the hearth section including grate tubes extending from the connector tube to define an upwardly opening U-shape thereof with an open front end such that a stove associated therewith can be stoked through a front door opening thereof as well as through a top opening thereof, the grate tubes having lower ends communicated with the central connector tube and upper ends spaced from each other, a pair of outlet tubes communicated with the upper ends of the grate tubes to receive heated fluid from the hearth section, the rear flue section including an inlet tube for supplying fluid to be heated to the flue section, and the flue section also including tubing communicated with the inlet tube and the connector tube to carry the fluid for preheating thereof by flue gases prior to passage therefrom to the hearth section.

2. A heat exchanger as in claim 1 wherein the flue section includes U-shaped tubes that open sideways in opposite directions and have upper ends communicated with the inlet tube and lower ends communicated with the connector tube that feeds the hearth section.

3. A heat exchanger that functions as a grate for an enclosed stove, the heat exchanger comprising: a front hearth section including a central connector tube and grate tubes extending from the connector tube to define an upwardly opening U-shape such that a stove associated therewith can be stoked through a front door opening thereof as well as through a top opening thereof, the grate tubes having a smaller size than the central connector tube and including lower ends communicated with the connector tube and upper ends spaced from each other, a pair of outlet tubes communicated with the upper ends of the grate tubes extending in a parallel relationship with each other and with the central connector tube, an inlet tube located above the connector tube extending parallel thereto, a rear flue section including U-shaped tubes that open sideways in opposite directions and have upper ends communicated with the inlet tube and lower ends communicated with the connector tube such that fluid to be heated supplied through the inlet tube is preheated by flue gases in the flue section prior to being fed through the connector tube to the hearth section for heating and subsequent delivery through the outlet tubes.

* * * * *